US007909183B2

(12) United States Patent
Oh

(10) Patent No.: US 7,909,183 B2
(45) Date of Patent: Mar. 22, 2011

(54) HANGER WITH A DISPLAY LIGHT BAR

(76) Inventor: Se-Ki Oh, Goyang-si (KR)

( * ) Notice: Subject to any disclaimer, the term of this patent is extended or adjusted under 35 U.S.C. 154(b) by 3 days.

(21) Appl. No.: 12/422,406

(22) Filed: Apr. 13, 2009

(65) Prior Publication Data

US 2010/0108628 A1 May 6, 2010

(30) Foreign Application Priority Data

Oct. 31, 2008 (KR) ..... 10-2008-0107428

(51) Int. Cl.
*A47F 5/08* (2006.01)

(52) U.S. Cl. ..... 211/59.1; 362/132; 362/234

(58) Field of Classification Search ..... 211/26, 211/26.2, 85.3, 123, 119, 59.1, 54.1, 57.1, 211/94.01, 118, 105.1, 96, 113; 362/132, 362/249.02, 396, 191, 234, 432; 248/220.22, 248/220.31, 220.41, 303; D8/373
See application file for complete search history.

(56) References Cited

U.S. PATENT DOCUMENTS

| | | | | |
|---|---|---|---|---|
| 2,743,023 | A * | 4/1956 | Larson | 211/96 |
| 4,351,440 | A * | 9/1982 | Thalenfeld | 211/57.1 |
| 4,394,909 | A * | 7/1983 | Valiulis et al. | 211/59.1 |
| 4,436,209 | A * | 3/1984 | Thalenfeld | 211/57.1 |
| 4,474,351 | A * | 10/1984 | Thalenfeld | 248/220.22 |
| 4,520,978 | A * | 6/1985 | Taub | 248/220.41 |
| 4,674,721 | A * | 6/1987 | Thalenfeld | 248/220.22 |
| 4,747,025 | A * | 5/1988 | Barton | 362/147 |
| 4,797,819 | A * | 1/1989 | Dechirot | 705/28 |
| 5,065,290 | A * | 11/1991 | Makar et al. | 362/132 |
| 5,485,930 | A * | 1/1996 | Rushing | 211/59.1 |
| 5,816,696 | A * | 10/1998 | Beisler | 362/396 |
| 6,006,463 | A * | 12/1999 | Mueller | 40/642.01 |
| 6,582,096 | B1 * | 6/2003 | Searer | 362/253 |
| 2003/0111435 | A1 * | 6/2003 | Chen | 211/123 |
| 2006/0146531 | A1 * | 7/2006 | Reo et al. | 362/244 |
| 2009/0207602 | A1 * | 8/2009 | Reed et al. | 362/225 |

FOREIGN PATENT DOCUMENTS

| | | |
|---|---|---|
| JP | 57-166775 | 10/1982 |
| JP | 04-053287 | 5/1992 |
| JP | P2006-217954 A | 8/2008 |
| KR | 10-0403365 | 10/2003 |

* cited by examiner

*Primary Examiner* — Darnell M Jayne
*Assistant Examiner* — Patrick Hawn
(74) *Attorney, Agent, or Firm* — King & Schickli, PLLC

(57) ABSTRACT

A hanger includes a display light bar and a hanging bar defining a support portion pivotally connected to the display light bar. The display light bar may be raised and lowered via the hinge pin. The display light bar defines a channel in which one or more LEDs may be arranged to emit lights of a desired color or colors, providing a method for identifying goods hung on the hanging bar at a distance. A tagger is provided at an opposed end of the display light bar for hanging a tagging plate providing additional information regarding the goods.

6 Claims, 3 Drawing Sheets

HANGER WITH A DISPLAY LIGHT BAR

TECHNICAL FIELD

The present invention relates to a hanger provided with a display light bar to help find the position of the goods on display from a distance based on the colors of the lights emitted from the display light bar.

BACKGROUND OF THE INVENTION

In general in a department store or a large store, a number of hangers are arranged in rows at places where goods are displayed, and clothes and various other kinds of goods are hung on the hangers. A small tagging plate may be provided, giving information on the goods displayed is placed at the fore end of each hanger. The customers visiting the store wander about in the store trying to find the goods they want and find the goods they have in mind from the information written on the tagging plate.

Conventionally, a variety of goods of the same kind manufactured by various makers are hung on display on hangers in a large store or a department store. Though a tagging plate is placed on each hanger, the customers visiting a store cannot read the information written on a tagging plate at a distance unless they come close to the tagging plate. As a result, the customers visiting a store expend effort and considerable time to find the goods they want to buy.

Accordingly, there is a need in the art for devices allowing the sellers of goods to help their customers find the kind of goods they want swiftly, as an alternative to conventional identification devices such as a tagging plate. By providing such convenience to the customer, such devices are advantageous also to the sellers' business.

SUMMARY OF THE INVENTION

In one aspect of the present disclosure there is provided a hanger for display of goods with a display light bar. That display light bar displays lights of certain colors so that the customers visiting a store may easily find the location of the desired goods even at a distance according to the light color display, even if goods of the same or similar kind are displayed by different makers in the same large, spacious store.

In another aspect there is provided a hanger in which a display light bar can be raised and lowered for the goods to be hung easily on a hanging bar and in which the colored lights on the display light bar are emitted from light-emitting diodes (LEDs) softly and only in a downward direction, preventing blinding of the customers' eyes as they read the information on the goods on display from the tagging plates.

The hanger is provided with a hanging bar which is welded to a bracket defining a bent suspend. The hanging bar may be bent, such as in a U-shape, on one end to define a support portion which may be pivotally connected to the display light bar, supporting the display light bar substantially horizontally. The display light bar may be raised and lowered to the substantially horizontal position via a hinge pin pivotally connecting the support portion and the display light bar.

The display light bar may be configured to provide a channel in which one or more LEDs may be arrayed to emit light beams of one or more predetermined colors, such as via alterations to a supplied voltage, so that the customers can easily find a particular kind of goods on display on hangers and their position of display by the color of the light emitted. A tagger is provided on the front end of the display light bar on which a tagging plate is hung for the customers to acquire additional specific details of the goods from the information written on the tagging plate after finding the position of the goods on display.

A number of hangers according to the present invention may be arranged in rows in a store using their brackets. After raising the display light bar, various kinds of goods such as clothes can be hung on the hanging bar. Then the display light bar is lowered to a substantially horizontal position and maintains that position supported by the hinge pin and the support position. With power supplied to the display light bar, lights of desired colors are emitted downward from the LEDs arranged on the display light bar. The LEDs emit light only in one direction. Accordingly, the LEDs arrayed so as to face downwardly in the channel emit lights only downward precluding the possibility of blinding the customers eyes. The skilled artisan will appreciate that the selection of various colors of light is made possible by the adjustment of voltage.

It will be appreciated that by use of the presently described hanger, customers visiting a store can easily find the position of a certain product or category of goods on display by the color of the light emitted from the hanger. For example, a red color may serve as an indicator to the customer that adult pants or shirts are hung on a particular hanger or group of hangers. After finding the position of the broad category of goods on display, the customers can then make a more specific selection of goods, such as individual sizes of clothing, by reading the information written on a tagging plate hung on an end portion of the hanger. Advantageously, the present hanger is simply constructed, easy to manufacture, and further is of a robust construction for long-term use in the manner described.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims. Unless otherwise indicated, any patent and non-patent citations discussed herein are specifically incorporated by reference in their entirety into the present disclosure.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE INVENTION

In the following detailed description of the illustrated embodiments, reference is made to the accompanying drawings that form a part hereof, and in which is shown by way of illustration, specific embodiments in which the invention may be practiced. These embodiments are described in sufficient detail to enable those skilled in the art to practice the invention. Also, it is to be understood that other embodiments may be utilized and that other changes may be made without departing from the scope of the present invention.

In the present invention, a display light bar provided with a number of colored LEDs is pivotally attached via a hinge pin to the support portion of a known hanging bar, whereby the display light bar may be lifted up and lowered down to its horizontal position. Accordingly, the display light bar can be lifted up and then goods can be hung easily on the hanger for display. The described hanger offers convenience for the customers to easily find the location of a particular kind of goods on display in a large, spacious store by the colors of the lights emitted from the display light bar. A benefit to the sellers of the goods is provided also by providing such convenience to customers. For that reason, the presently described hanger offers various advantageous effects making it more useful in a store compared with conventional hangers.

Figure 1:
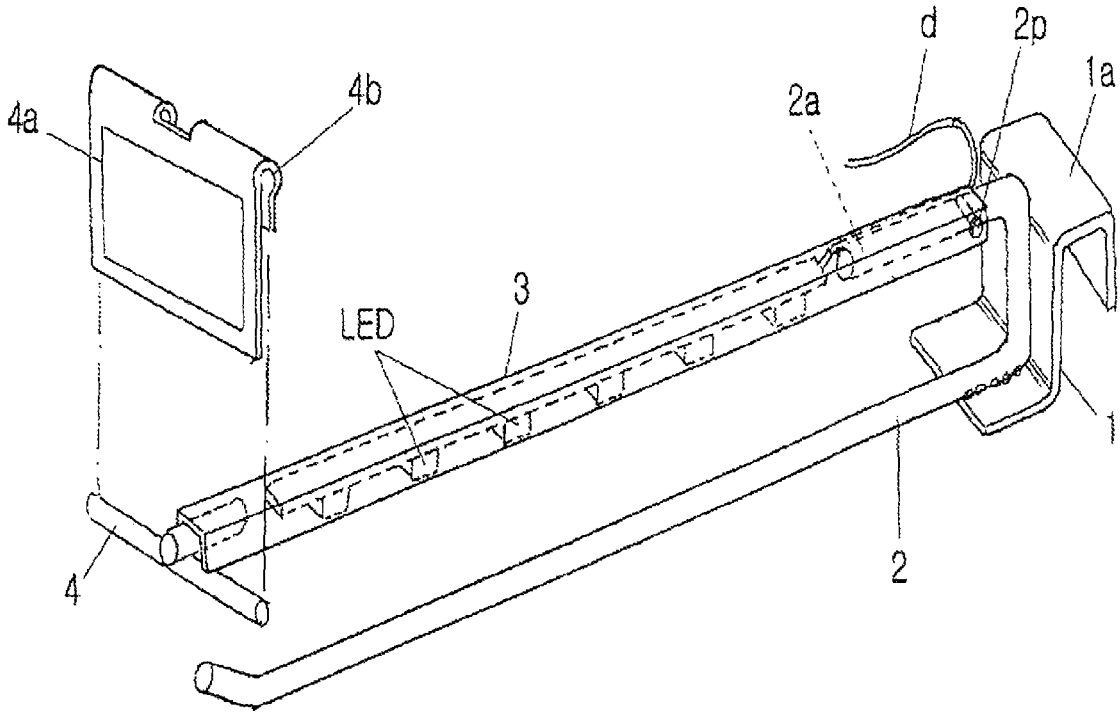
FIG. 1 is a perspective view of an embodiment of the present invention.
Figure 2:
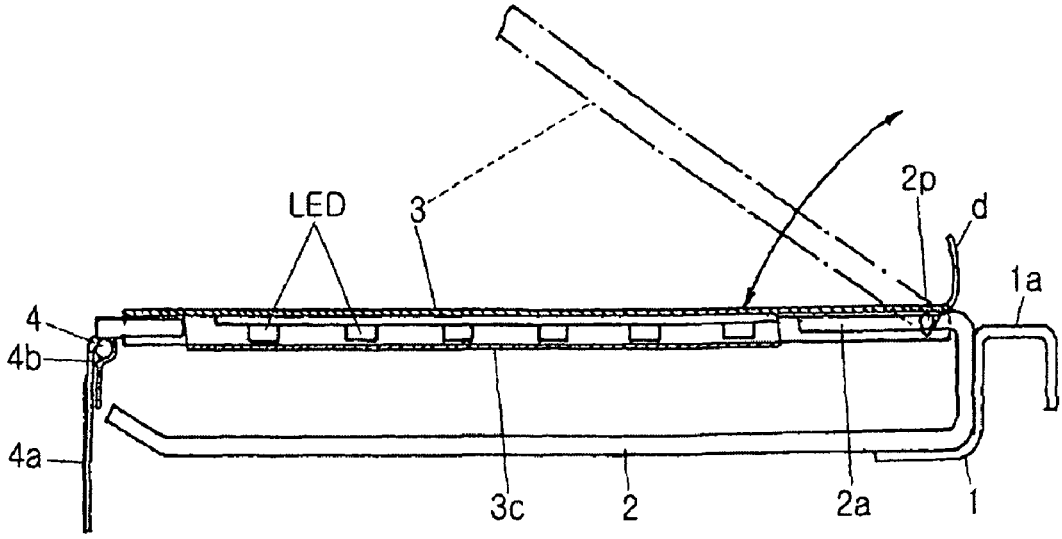
FIG. 2 is a partially cutaway side view of the present invention.
Figure 3:
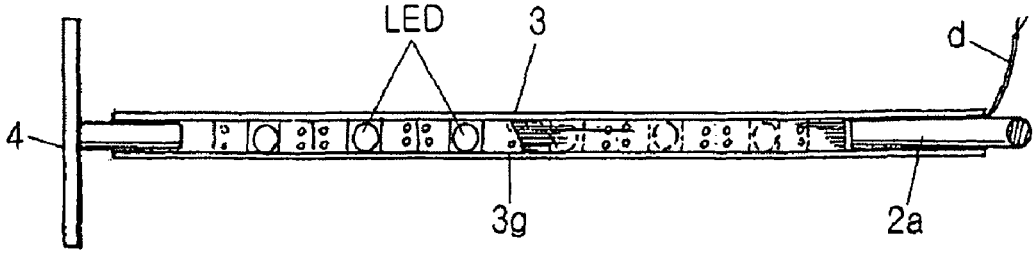
FIG. 3 is a bottom view of the display light bar in the present invention.
Figure 4:
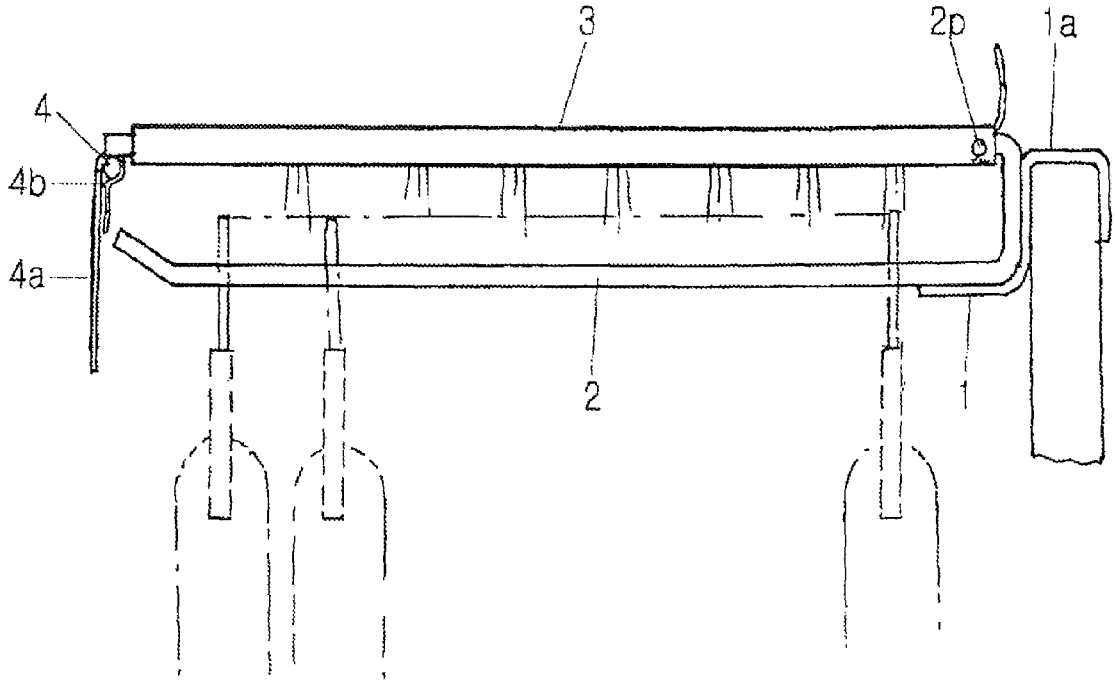
FIG. 4 is a side view of the hanger in the present invention showing an example of the hanger in use.

With reference to FIG. 1, in the present hanger a long hanging bar (2) is integrally welded to a bracket (1) having a suspend (1*a*) bent in a U-shaped form. The suspend (1*a*) may be used to hang the hanger from a supporting structure, such as a wall, a rack, a shelf system, or the like. An end portion of the hanging bar (2) is bent, such as in a U-shaped form, to form a support portion (2*a*) which is inserted into an end of a display light bar (3). The support portion (2*a*) and the end portion of the display light bar (3) are pivotally connected via a hinge pin (2*p*), whereby the support portion (2*a*) supports the display light bar (3) horizontally. As shown in FIG. 2 and FIG. 3, the display light bar (3) is provided with one or more LEDs of various colors arrayed in a long narrow channel (3*g*), and may be provided with a transparent cover (3*c*) at its bottom portion. A power cord (d) is operatively connected to the LEDs to provide an electrical current thereto. A tagger (4), which in the depicted embodiment is substantially T-shaped, may be provided at the end of the display light bar (3) opposed to the support portion (2*a*), for supporting a tagging plate (4*a*) via a hook (4*b*).

The hanger as described above may be placed in desired numbers in rows in a store selling various goods by hanging it via the suspend (1*a*) of the bracket (1). In use, the display light bar (3) is pivoted upwardly via the hinge pin (2*p*), and then various kinds of goods such as clothes may be hung on the hanging bar (2) for display. The display light bar (3) is then returned to a substantially horizontal position and remains in that substantially horizontal position being supported by the hinge pin (2*p*) and the support portion (2*a*). When an electrical current is supplied to the display light bar (3) through power cord (d), lights of desired colors are emitted from the LEDs of the display light bar (3). The LEDs are configured to emit light only in one direction. Because in the presently described embodiment the LEDs are arranged downward in the channel of the display light bar (3), the light emitted by the LEDs is emitted only in a downward direction relative to the orientation of the hanger, precluding the possibility of blinding the customers' eyes.

Still further, the desired color of the light emitted by the LEDs can be selected by adjusting the voltage supplied through the power cord (d). For example, as is known to the skilled artisan, the operating voltage for a red light is 1.8 v~2.0 v, the operating voltage for a green light is 3.0 v~3.6 v, the operating voltage for a blue light is 3.4 v~3.8 v, and the operating current is about 20 mA in all cases.

Therefore, it will be readily apparent that a predetermined color coding system may be established wherein a certain color may be designated for each kind of goods, and that information may be supplied to the customer. The customer need not wander about the large store area in search of the desired goods, but can locate the position of a certain kind of goods on display easily from a distance by the color of the light emitted from the hanger. After finding the position of the goods on display, the customer can read more specific information about the goods from a tagging plate (4*a*) hung at an end of the hanger and buy the goods he or she wants to buy.

This detailed description, and particularly the specific details of the exemplary embodiments, is given primarily for clarity of understanding, and no unnecessary limitations are to be imported, for modifications will become obvious to those skilled in the art upon reading this disclosure and may be made without departing from the spirit or scope of the invention. Relatively apparent modifications, of course, include combining the various features of one or more figures or examples with the features of one or more of other figures or examples.

What is claimed is:

1. A hanger for hanging goods for display, comprising:

a substantially U-shaped support portion having a bottom, elongated end, an intermediate U-shaped portion, and a top end, the bottom, elongated end defining a hanging bar for supporting one or more goods to be displayed;

a display light bar for identifying the one or more goods according to a predetermined color coding system by a color of light emitted therefrom, the display light bar extending from and connected to the top end of the substantially U-shaped support portion by a hinge pin whereby the display light bar pivots relative to the hanging bar; and a bracket attached to the intermediate U-shaped portion and defining a suspend for suspending the hanger from a supporting structure;

wherein the display light bar defines a U-shaped channel provided with one or more LEDs arrayed therein to emit light only in a downward direction, said channel being covered with a transparent cover at a bottom portion thereof.

2. The hanger of claim 1, wherein the hanging bar defines the support portion for pivotally supporting the display light bar whereby the pivotally connected display light bar is capable of being raised from a substantially horizontal position for adding goods to the hanging bar.

3. The hanger of claim 1, further including a power cord operatively connected to the LEDs for supplying an electrical current thereto.

4. The hanger of claim 2, further including a T-shaped tagger provided at an end of the display light bar opposite the support portion for supporting a tagging plate.

5. A hanger for hanging goods for display, comprising:

a substantially U-shaped support portion having a bottom, elongated end, an intermediate U-shaped portion and a top end, the bottom, elongated end defining a hanging bar for supporting one or more goods to be displayed;

a bracket defining a suspend for suspending the hanging bar from a supporting structure, the bracket being attached to the intermediate U-shaped portion;

a display light bar for identifying the one or more goods according to a predetermined color coding system by a color of light emitted therefrom, the display light bar extending from and connected to the top end of the substantially U-shaped support portion by a hinge pin whereby the display light bar pivots relative to the hanging bar and the bracket; and a tagger disposed at an end of the display light bar distal to the U-shaped support portion, the tagger comprising a T-shaped support for supporting a panel;

wherein the display light bar defines an elongated U-shaped channel having a plurality of LEDs arrayed therein to emit light only in a downward direction to illuminate the one or more goods displayed on the support portion, said channel being covered with a transparent cover at a bottom portion thereof.

6. The hanger of claim 5, further including a power cord operatively connected to the LEDs for supplying an electrical current thereto.

* * * * *